US009837724B2

(12) United States Patent
Jan et al.

(10) Patent No.: US 9,837,724 B2
(45) Date of Patent: Dec. 5, 2017

(54) ANTENNA SYSTEM

(71) Applicant: Wistron NeWeb Corp., Hsinchu (TW)

(72) Inventors: Cheng-Geng Jan, Hsinchu (TW); Chieh-Sheng Hsu, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 0 days.

(21) Appl. No.: 15/188,475

(22) Filed: Jun. 21, 2016

(65) Prior Publication Data

US 2017/0256863 A1 Sep. 7, 2017

(30) Foreign Application Priority Data

Mar. 1, 2016 (TW) ..... 105106087 A

(51) Int. Cl.

| | |
|---|---|
| ***H01Q 19/10*** | (2006.01) |
| ***H01Q 15/14*** | (2006.01) |
| ***H01Q 1/36*** | (2006.01) |
| ***H01Q 19/13*** | (2006.01) |

(52) U.S. Cl.

CPC ..... *H01Q 15/14* (2013.01); *H01Q 1/36* (2013.01); *H01Q 19/136* (2013.01)

(58) Field of Classification Search

None

See application file for complete search history.

(56) References Cited

U.S. PATENT DOCUMENTS 3,702,479 A * 11/1972 Uhrig ..... B64C 1/36 343/705
5,710,569 A 1/1998 Oh et al.
6,133,883 A * 10/2000 Munson ..... H01Q 1/38 343/700 MS
6,252,559 B1 6/2001 Donn
6,295,028 B1 * 9/2001 Jonsson ..... H01Q 1/246 343/700 MS
6,320,553 B1 11/2001 Ergene
6,377,226 B1 * 4/2002 Ha ..... H01Q 1/242 343/791
6,975,278 B2 12/2005 Song et al.
7,173,572 B2 * 2/2007 Teillet ..... H01Q 1/246 343/795
7,427,966 B2 * 9/2008 Boss ..... H01Q 21/26 343/797
7,616,168 B2 * 11/2009 Tillery ..... H01Q 1/246 343/797

(Continued)

FOREIGN PATENT DOCUMENTS

CN 103730728 A 4/2014

*Primary Examiner* — Trinh Dinh

(74) *Attorney, Agent, or Firm* — Muncy, Geissler, Olds & Lowe, P.C.

(57) ABSTRACT

An antenna system includes a dual-polarized antenna, a main reflector, and an auxiliary reflector. The dual-polarized antenna includes a first antenna element and a second antenna element. The first antenna element and the second antenna element operate in a low-frequency band and a high-frequency band. The first antenna element and the second antenna element have different polarization directions. The main reflector is configured to reflect the electromagnetic waves in the low-frequency band. The auxiliary reflector is positioned between the dual-polarized antenna and the main reflector, and is configured to reflect the electromagnetic waves in the high-frequency band.

18 Claims, 10 Drawing Sheets

(56) References Cited

U.S. PATENT DOCUMENTS

| | | | | |
|---|---|---|---|---|
| 7,692,601 | B2 * | 4/2010 | Bisiules | H01P 5/103 343/797 |
| 7,978,194 | B2 * | 7/2011 | Seiler | G06T 15/405 345/421 |
| 8,212,734 | B1 | 7/2012 | Matyas et al. | |
| 8,558,748 | B2 * | 10/2013 | Chen | H01Q 19/30 343/792.5 |
| 2006/0114168 | A1 * | 6/2006 | Gottl | H01Q 1/246 343/797 |
| 2012/0280881 | A1 | 11/2012 | Beausang | |
| 2014/0062822 | A1 * | 3/2014 | Tseng | H01Q 21/26 343/798 |
| 2017/0125917 | A1 * | 5/2017 | Lin | H01Q 21/06 |

* cited by examiner

ANTENNA SYSTEM

CROSS REFERENCE TO RELATED APPLICATIONS

This Application claims priority of Taiwan Patent Application No. 105106087 filed on Mar. 1, 2016, the entirety of which is incorporated by reference herein.

BACKGROUND OF THE INVENTION

Field of the Invention

The disclosure generally relates to an antenna system, and more particularly to a high-gain, multiband, and dual-polarized antenna system.

Description of the Related Art

With advancement in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements for mobile devices in the room to connect to the Internet at a high speed. However, since indoor environments have serious signal reflection and multipath fading, wireless access points should process signals in a variety of polarization directions and from a variety of transmission directions simultaneously. Accordingly, it has become a critical challenge for antenna designers to design a high-gain, multiband, and dual-polarized antenna in the limited space of wireless access points.

BRIEF SUMMARY OF THE INVENTION

In an embodiment, the disclosure is directed to an antenna system including a dual-polarized antenna, a main reflector, and an auxiliary reflector. The dual-polarized antenna includes a first antenna element and a second antenna element. The first antenna element and the second antenna element operate in a low-frequency band and a high-frequency band. The first antenna element and the second antenna element have different polarization directions. The main reflector is configured to reflect the electromagnetic waves in the low-frequency band. The auxiliary reflector is positioned between the dual-polarized antenna and the main reflector, and is configured to reflect the electromagnetic waves in the high-frequency band.

In some embodiments, the first antenna element has a first polarization direction, and the second antenna element has a second polarization direction. The second polarization direction is perpendicular to the first polarization direction.

In some embodiments, the first antenna element is disposed on a first dielectric substrate, and the second antenna element is disposed on a second dielectric substrate. The second dielectric substrate is perpendicular to the first dielectric substrate.

In some embodiments, the main reflector is a box without a lid, and a top opening of the box faces the dual-polarized antenna.

In some embodiments, the auxiliary reflector is a plane.

In some embodiments, the electromagnetic waves in the low-frequency band are capable of penetrating the auxiliary reflector.

In some embodiments, the first antenna element and the second antenna element are dipole antenna elements or bowtie antenna elements.

In some embodiments, each of the first antenna element and the second antenna element includes a pair of first radiation elements, a pair of second radiation elements, and a pair of third radiation elements. The second radiation elements are disposed between the first radiation elements and the third radiation elements.

In some embodiments, the first radiation elements and the second radiation elements are excited to generate electromagnetic wave in the low-frequency band, and the third radiation elements are excited to generate electromagnetic wave in the high-frequency band.

In some embodiments, each of the first antenna element and the second antenna element further includes a pair of reflector elements for reflecting the electromagnetic waves in the high-frequency band. The reflector elements are disposed between the third radiation elements and the auxiliary reflector.

In some embodiments, each of the first antenna element and the second antenna element further includes a pair of director elements for directing the electromagnetic waves in the high-frequency band to transmit outwardly. The first radiation elements are disposed between the director elements and the second radiation elements.

In some embodiments, each of the first antenna element and the second antenna element further includes a signal source and a coaxial cable.

In some embodiments, the coaxial cable includes a conductive housing, and the conductive housing is soldered to the main reflector.

In some embodiments, the auxiliary reflector has an opening. The coaxial cable extends through the opening and does not directly touch the auxiliary reflector.

In some embodiments, each of the first antenna element and the second antenna element further includes a choke element. The choke element is applied to the coaxial cable.

In some embodiments, the choke element is a low-pass filter.

In some embodiments, the choke element is a hollow cylindrical tube which surrounds the coaxial cable.

In some embodiments, the hollow cylindrical tube has an open end and a closed end. The open end of the hollow cylindrical tube does not directly touch the coaxial cable. The closed end of the hollow cylindrical tube is soldered to the conductive housing of the coaxial cable.

In some embodiments, a length of the hollow cylindrical tube is shorter than 0.25 wavelength of the high-frequency band.

In some embodiments, the choke element is an L-shaped element. The L-shaped element has a connection end and an open end. The connection end of the L-shaped element is soldered to the conductive housing of the coaxial cable. The open end of the L-shaped element does not directly touch the coaxial cable.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1A:
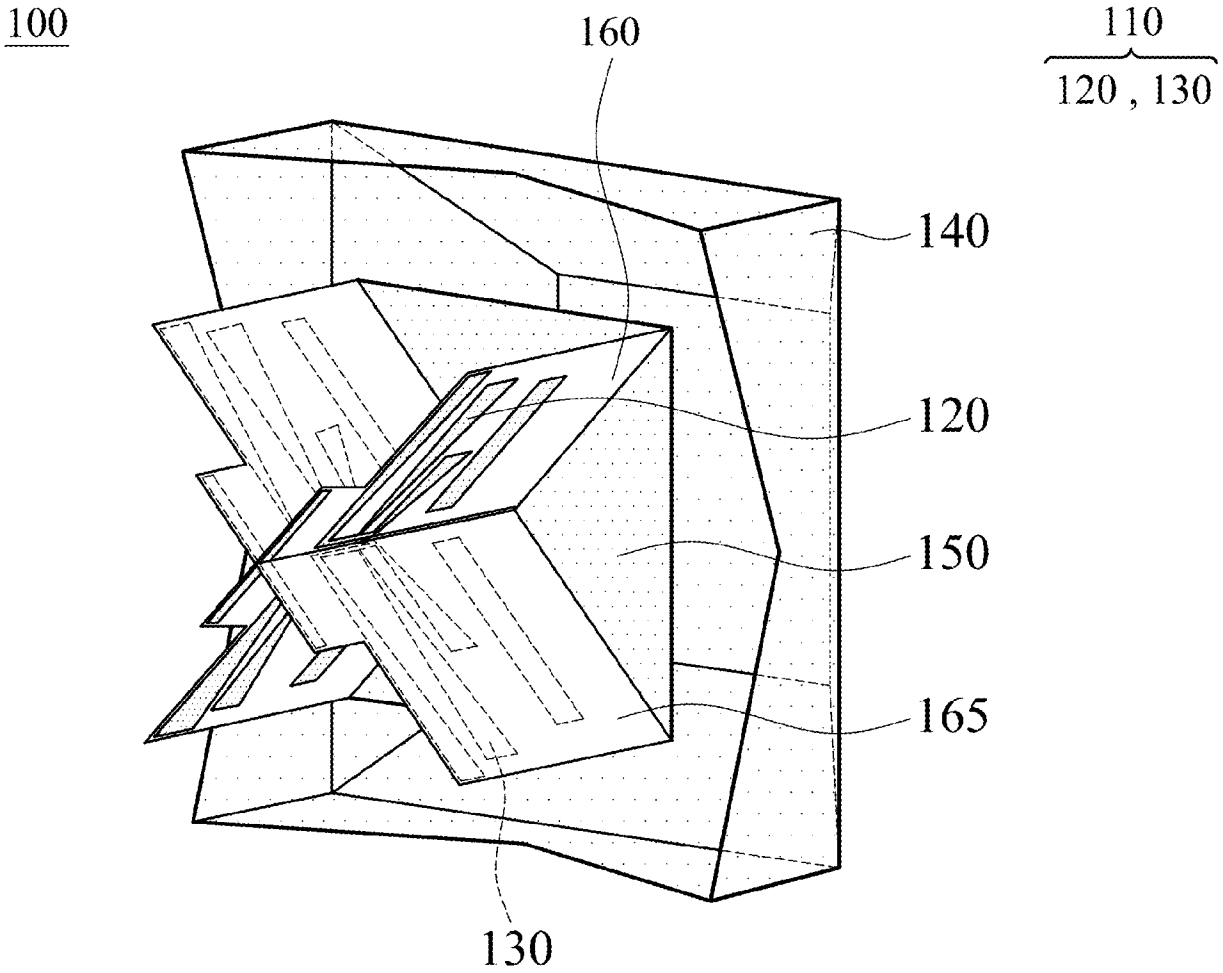
FIG. 1A is a perspective view of an antenna system according to an embodiment of the invention.
Figure 1B:
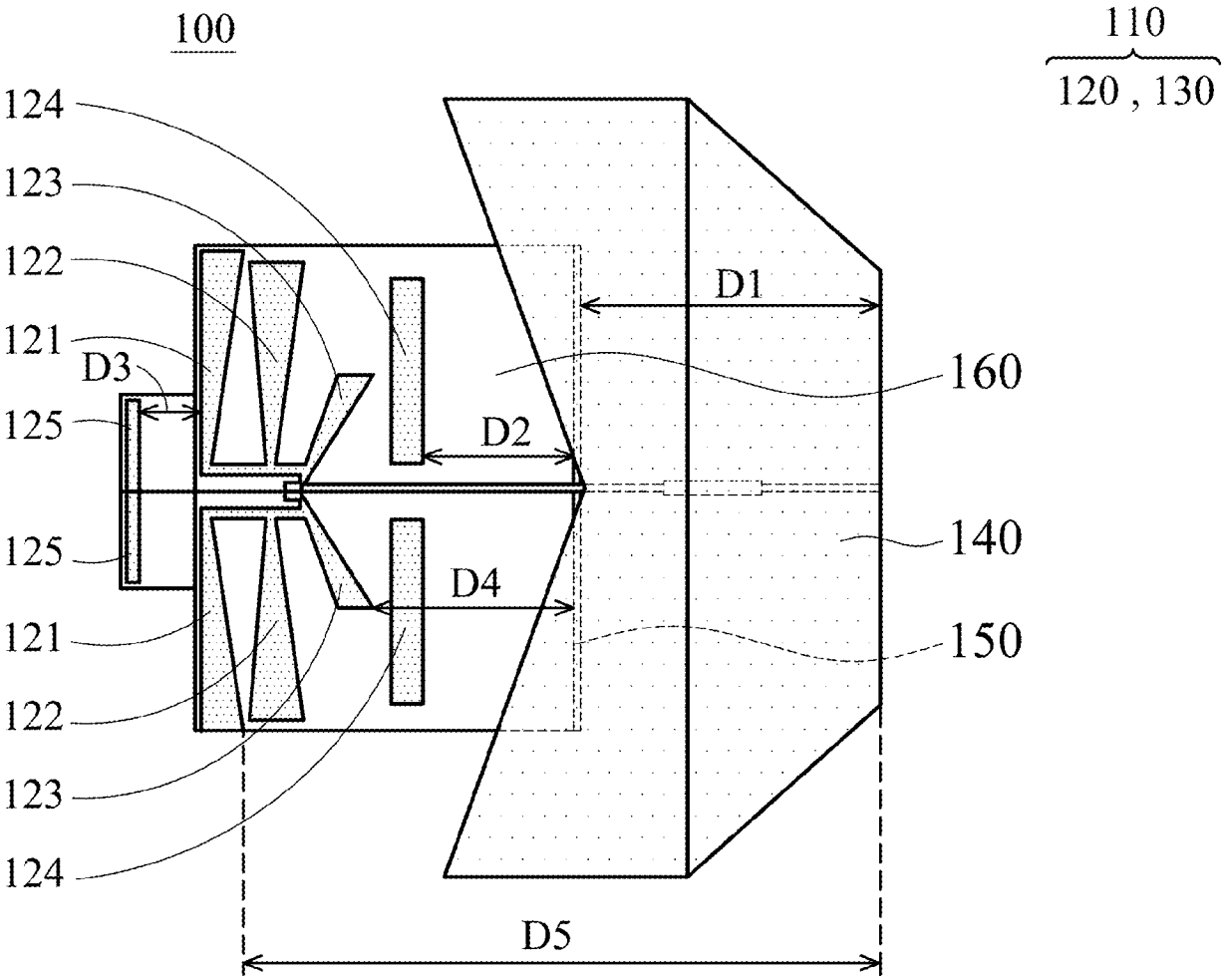
FIG. 1B is a side view of an antenna system according to an embodiment of the invention.
Figure 1C:
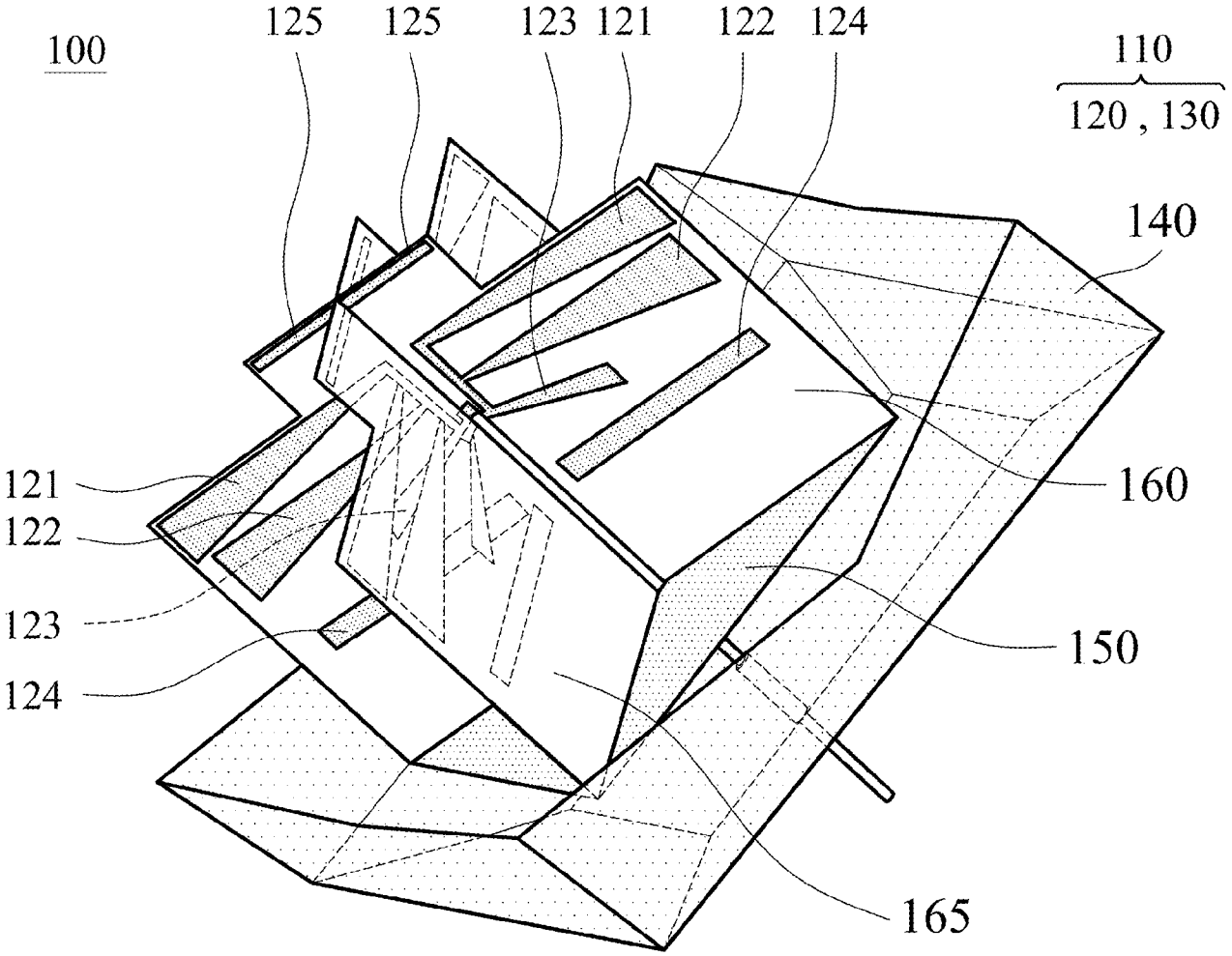
FIG. 1C is a perspective view of an antenna system according to an embodiment of the invention.

FIG. 1A is a perspective view of an antenna system 100 according to an embodiment of the invention. FIG. 1B is a side view of the antenna system 100 according to an embodiment of the invention. FIG. 1C is a perspective view of the antenna system 100 according to an embodiment of the invention. Please refer to FIG. 1A, FIG. 1B, and FIG. 1C together. The antenna system 100 can be applied in a wireless access point, and it can generate a dual-polarized radiation pattern. As shown in FIG. 1A, FIG. 1B, and FIG. 1C, the antenna system 100 at least includes a dual-polarized antenna 110, a main reflector 140, and an auxiliary reflector 150. The aforementioned dual-polarized antenna 110, main reflector 140, and auxiliary reflector 150 are made of conductive materials, such as copper, silver, aluminum, iron, or their alloys.

The dual-polarized antenna 110 includes a first antenna element 120 and a second antenna element 130. The first antenna element 120 is disposed on a first dielectric substrate 160. The second antenna element 130 is disposed on a second dielectric substrate 165. The second dielectric substrate 165 is perpendicular to the first dielectric substrate 160. Each of the first dielectric substrate 160 and the second dielectric substrate 165 may be an FR4 (Flame Retardant 4) substrate. In some embodiments, each of the first dielectric substrate 160 and the second dielectric substrate 165 substantially has an inverted T-shape, and the two inverted T-shapes are combined with each other. The first antenna element 120 and the second antenna element 130 are multiband, and they operate in at least a low-frequency band and a high-frequency band. For example, the aforementioned low-frequency band may include LTE (Long Term Evolution) Band 5/13 from 746 MHz to 894 MHz, and the aforementioned high-frequency band may include LTE Band 2/4 from 1710 MHz to 2155 MHz. The first antenna element 120 and the second antenna element 130 have different polarization directions. In some embodiments, the first antenna element 120 has a first polarization direction (e.g., the +45-degree direction), and the second antenna element 130 has a second polarization direction (e.g., the +135-degree direction). The second polarization direction is perpendicular to the first polarization direction. The dual-polarized antenna 110 is configured to transmit and receive the signals in different polarization directions.

The main reflector 140 may be a box without a lid, and a top opening of the box may face the dual-polarized antenna 110. Specifically, each side wall of the main reflector 140 may have a triangular concave notch, and the main reflector 140 may have an inverted pyramid structure. For example, the total area of the top opening of the main reflector 140 may be larger than the total area of the bottom plate of the main reflector 140. The main reflector 140 is configured to reflect the electromagnetic waves in the low-frequency band. The auxiliary reflector 150 is a plane, which may be completely inside the top opening of the main reflector 140. The auxiliary reflector 150 is disposed between the dual-polarized antenna 110 and the main reflector 140, and is configured to reflect the electromagnetic waves in the high-frequency band. Ideally, the electromagnetic waves in the low-frequency band can penetrate the auxiliary reflector 150, but they are completely reflected by the main reflector 140; on the other hand, the electromagnetic waves in the high-frequency band cannot penetrate the auxiliary reflector 150, and they are completely reflected by the auxiliary reflector 150. Both the main reflector 140 and the auxiliary reflector 150 are configured to enhance the antenna gain of the dual-polarized antenna 110. Since the dual-polarized antenna 110 has a relatively wide operation bandwidth, the invention proposes the main reflector 140 and the auxiliary reflector 150 which correspond to the low-frequency band and the high-frequency band of the dual-polarized antenna 110, respectively. As a result, the electromagnetic waves over the whole wide operation bandwidth of the dual-polarized antenna 110 can be completely reflected.

In some embodiments, the first antenna element 120 and the second antenna element 130 are dipole antenna elements or bowtie antenna elements. The first antenna element 120 and the second antenna element 130 have identical structures. The only difference is that the second antenna element 130 is considered as a duplicate of the first antenna element 120, which is rotated by 90 degrees with respect to its central axis. Thus, the following embodiments and figures are merely arranged to describe the structure of the first antenna element 120.

The first antenna element 120 includes a pair of first radiation elements 121, a pair of second radiation elements 122, and a pair of third radiation elements 123. The second radiation elements 122 are disposed between the first radiation elements 121 and the third radiation elements 123. Each of the first radiation elements 121, the second radiation elements 122, and the third radiation elements 123 may have a straight-line shape or a triangular shape. In some embodiments, the length of each first radiation element 121 is slightly longer than the length of each second radiation element 122. In some embodiments, the length of each first radiation element 121 is at least two times the length of each third radiation element 123. The first radiation elements 121 and the second radiation elements 122 can be excited to generate electromagnetic wave in the aforementioned low-frequency band. The third radiation elements 123 can be excited to generate electromagnetic wave in the aforementioned high-frequency band. The first antenna element 120 may further include a pair of reflector elements 124 for reflecting the electromagnetic waves in the high-frequency band. The reflector elements 124 are disposed between the third radiation elements 123 and the auxiliary reflector 150. Each of the reflector elements 124 may substantially have a straight-line shape. In some embodiments, the length of each reflector element 124 may be slightly longer than the length of each third radiation element 123, and the two reflector elements 124 are floating and not connected to each other. The first antenna element 120 may further include a pair of director elements 125 for directing the electromagnetic waves in the high-frequency band to transmit outwardly. The director elements 125 are positioned at one side of the first radiation elements 121, such that the first radiation elements 121 are disposed between the director elements 125 and the second radiation elements 122. Each of the director elements 125 may substantially have a straight-line shape. In some embodiments, the length of each director element 125 may be slightly shorter than the length of each third radiation element 123, and the two director elements 125 are floating and connected to each other. The reflector elements 124 and the director elements 125 are optional, and they are configured to enhance the high-frequency antenna gain of the dual-polarized antenna 110.

Figure 2A:
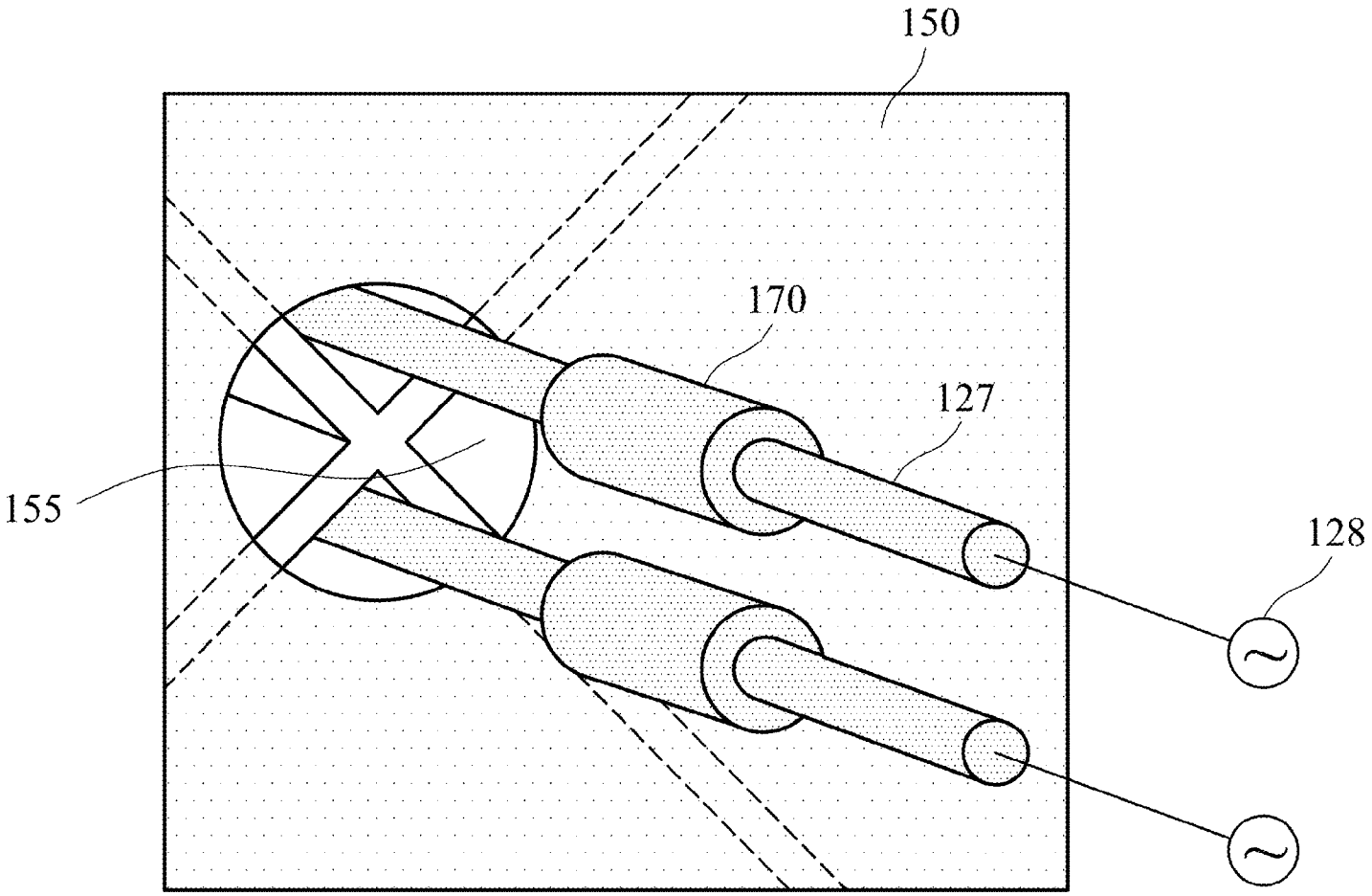
FIG. 2A is a partial perspective view below an auxiliary reflector of an antenna system according to an embodiment of the invention.

FIG. 2A is a partial perspective view below the auxiliary reflector 150 of the antenna system 100 according to an embodiment of the invention. In the embodiment of FIG. 2A, the first antenna element 120 further includes a signal source 128, a coaxial cable 127, and a choke element 170. The signal source 128 may be an RF (Radio Frequency) module, and it can generate an RF signal or process the received RF signal. The signal source 128 is coupled through the coaxial cable 127 to the first antenna element 120. The coaxial cable 127 includes a central conductive line (signal line) and a conductive housing (ground line). The conductive housing of the coaxial cable 127 is soldered to the main reflector 140. The auxiliary reflector 150 has an opening 155. The opening 155 may have a circular shape, a rectangular shape, or a square shape. The central conductive line and the conductive housing of the coaxial cable 127 extend through the opening 155 and do not directly touch the auxiliary reflector 150. Ideally, the electromagnetic waves in high-frequency band cannot penetrate the auxiliary reflector 150; however, according to the simulation result of the electromagnetic simulation software, there are still partial electromagnetic waves penetrating the auxiliary reflector 150 in the frequency interval from 1710 MHz to 1755 MHz, and it degrades the radiation performance of the antenna system 100. To solve this problem, the choke element 170 is newly added and applied to the coaxial cable 127. The choke element 170 is considered as a low-pass filter for preventing the electromagnetic waves in the high-frequency band from penetrating the auxiliary reflector 150. In some embodiments, the choke element 170 is positioned between the main reflector 140 and the auxiliary reflector 150. In alternative embodiments, the position of the choke element 170 is moved slightly forward or backward, without affecting its performance.

Figure 2B:
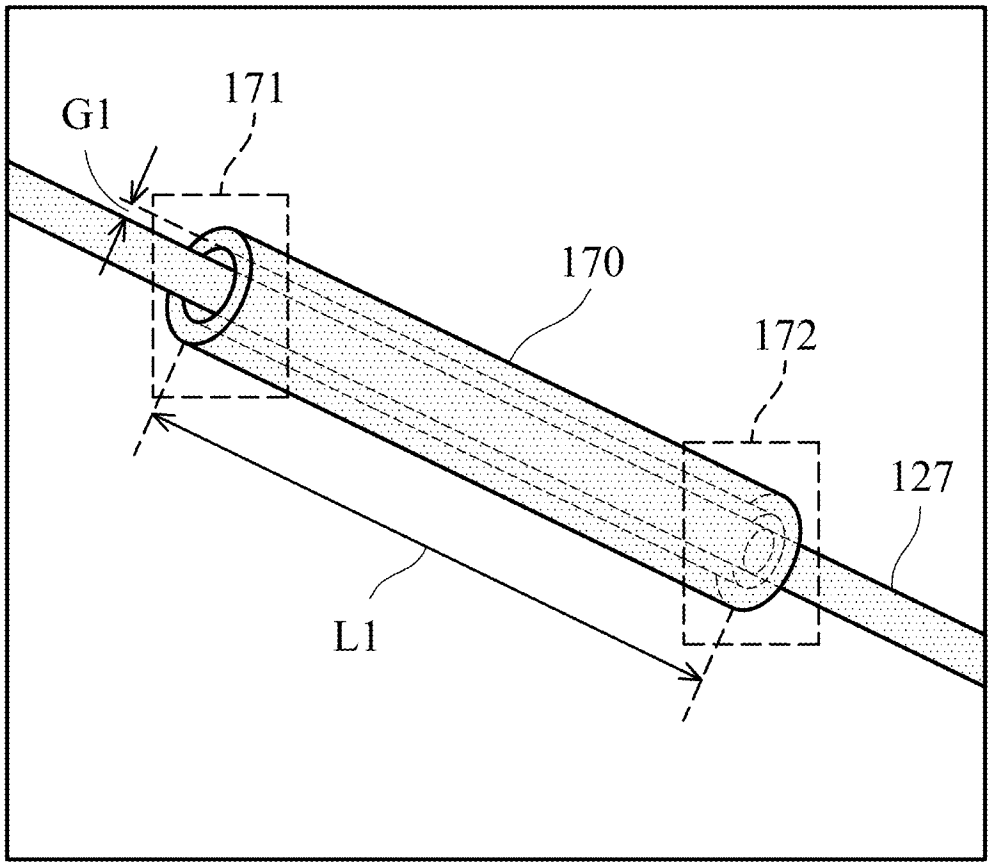
FIG. 2B is a combined view of a choke element according to an embodiment of the invention.
Figure 2C:
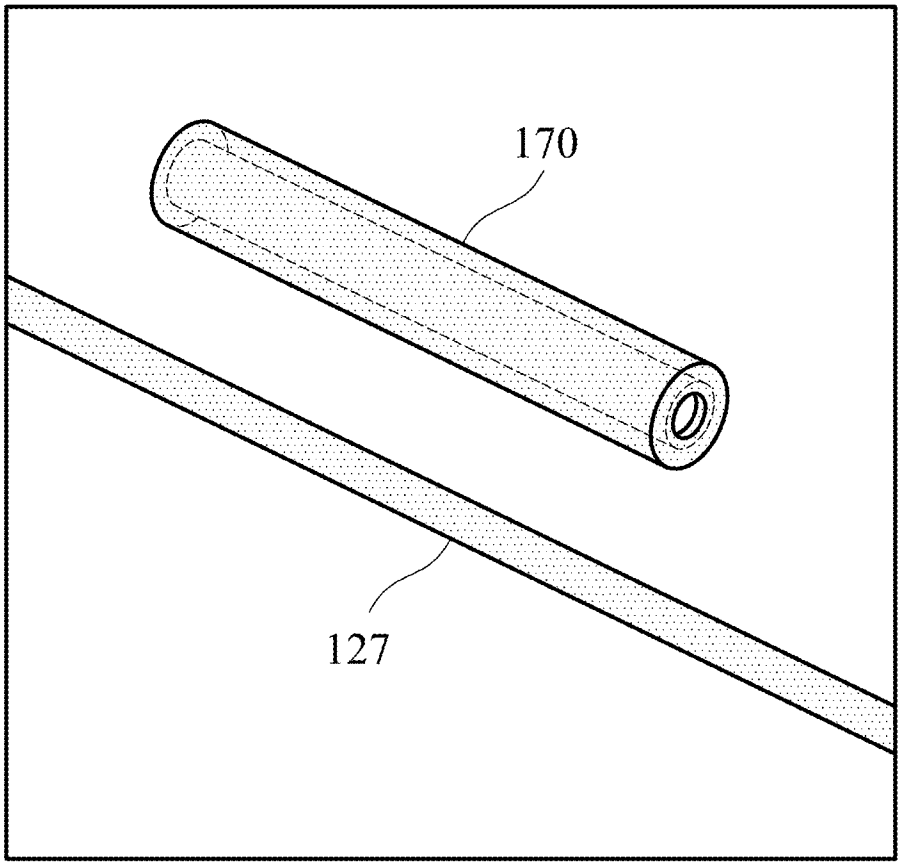
FIG. 2C is an exploded view of a choke element according to an embodiment of the invention.

FIG. 2B is a combined view of the choke element 170 according to an embodiment of the invention. FIG. 2C is an exploded view of the choke element 170 according to an embodiment of the invention. Please refer to FIG. 2B and FIG. 2C together. The choke element 170 is a hollow cylindrical tube which surrounds the coaxial cable 127. Specifically, the hollow cylindrical tube has an open end 171 and a closed end 172. The open end 171 of the hollow cylindrical tube does not directly touch the coaxial cable 127. The closed end 172 of the hollow cylindrical tube is soldered to the conductive housing of the coaxial cable 127. The length L1 of the hollow cylindrical tube is shorter than 0.25 wavelength of the aforementioned high-frequency band, so as to form a low-pass filter with inductive characteristics. A gap G1 between the hollow cylindrical tube and the conductive housing of the coaxial cable 127 is used to adjust the impedance value of the choke element 170. For example, if the gap G1 between the hollow cylindrical tube and the conductive housing of the coaxial cable 127 becomes wider, the impedance value of the choke element 170 will decrease, and conversely, if the gap G1 between the hollow cylindrical tube and the conductive housing of the coaxial cable 127 becomes narrower, the impedance value of the choke element 170 will increase.

Figure 3:
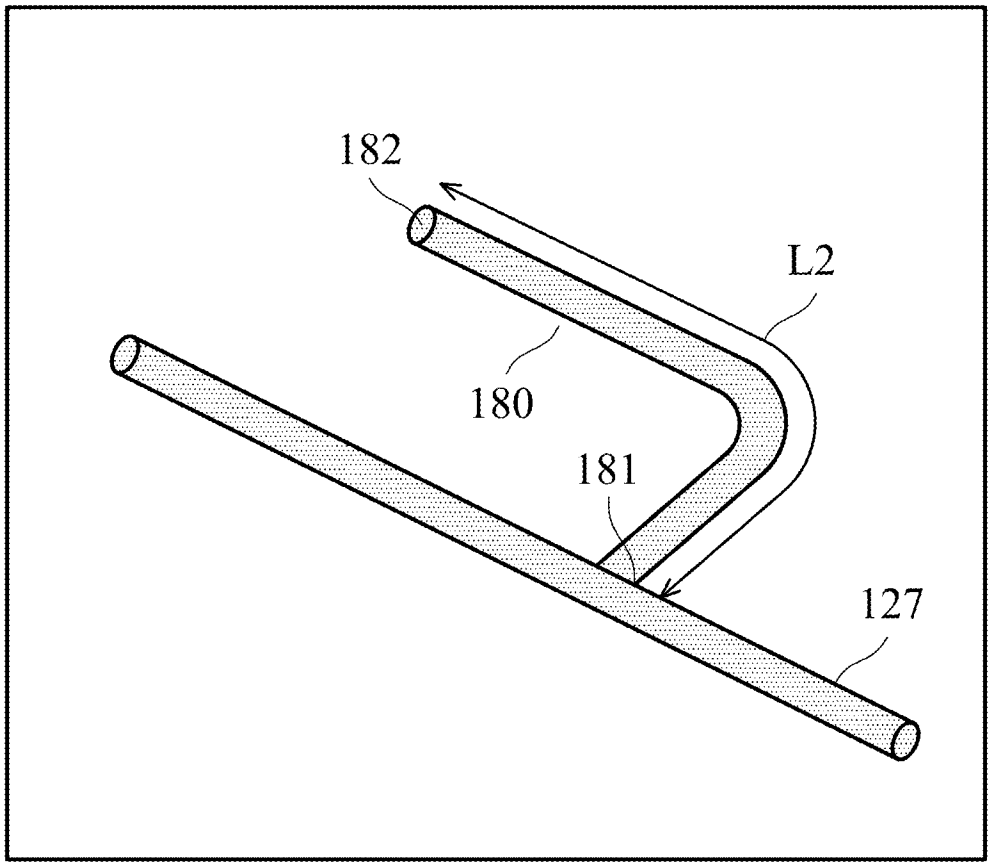
FIG. 3 is a combined view of a choke element according to another embodiment of the invention.

FIG. 3 is a combined view of a choke element 180 according to another embodiment of the invention. The choke element 180 is an L-shaped element, and it can be applied to the coaxial cable 127. Specifically, the L-shaped element has a connection end 181 and an open end 182. The connection end 181 of the L-shaped element is soldered to the conductive housing of the coaxial cable 127. The open end 182 of the L-shaped element extends parallel to the coaxial cable 127, and does not directly touch the coaxial cable 127. The length L2 of the L-shaped element is shorter than 0.25 wavelength of the aforementioned high-frequency band, so as to form a low-pass filter with inductive characteristics. According to the simulation result of electromagnetic simulation software, the function of the L-shaped choke element 180 is similar to the function of the aforementioned choke element 170.

In some embodiments, the element sizes of the antenna system 100 are as follows. The length of each first radiation element 121 is approximately equal to 0.25 wavelength of the aforementioned low-frequency band (e.g., from 50 mm to 60 mm, and can be 57.2 mm). The length of each second radiation element 122 is approximately equal to 0.25 wavelength of the aforementioned low-frequency band (e.g., from 50 mm to 60 mm, and can be 52.5 mm). The length of each third radiation element 123 is approximately equal to 0.25 wavelength of the aforementioned high-frequency band (e.g., from 20 mm to 40 mm, and can be 24 mm). The distance D1 between the auxiliary reflector 150 and the main reflector 140 is from 50 mm to 60 mm, and can be 59 mm. The distance D2 between the reflector elements 124 and the auxiliary reflector 150 is from 20 mm to 30 mm, and can be 24.5 mm. The distance D3 between the director elements 125 and the first radiation elements 121 is from 10 mm to 20 mm, and can be 16 mm. The distance D4 between the third radiation elements 123 and the auxiliary reflector 150 is approximately equal to 0.25 wavelength of the aforementioned high-frequency band (e.g., from 20 mm to 40 mm, and can be 34.5 mm). The distance D5 between the first radiation elements 121 and the main reflector 140 (its bottom plate) is approximately equal to or longer than 0.5 wavelength of the aforementioned low-frequency band (e.g., from 100 mm to 120 mm, and can be 112.5 mm). The diameter of the conductive housing of the coaxial cable 127 is about 1.2 mm. The inner diameter of the choke element 170 (hollow cylindrical tube) is about 1.8 mm, and the outer diameter of the choke element 170 is about 2.4 mm. The above element sizes are calculated according to many simulation results, and they are arranged for optimizing the antenna gain and isolation of the antenna system 100.

It should be noted that all of the components related to the first antenna element 120 can be applied to the second antenna element 130 correspondingly, and they will not be described again.

Figure 4A:
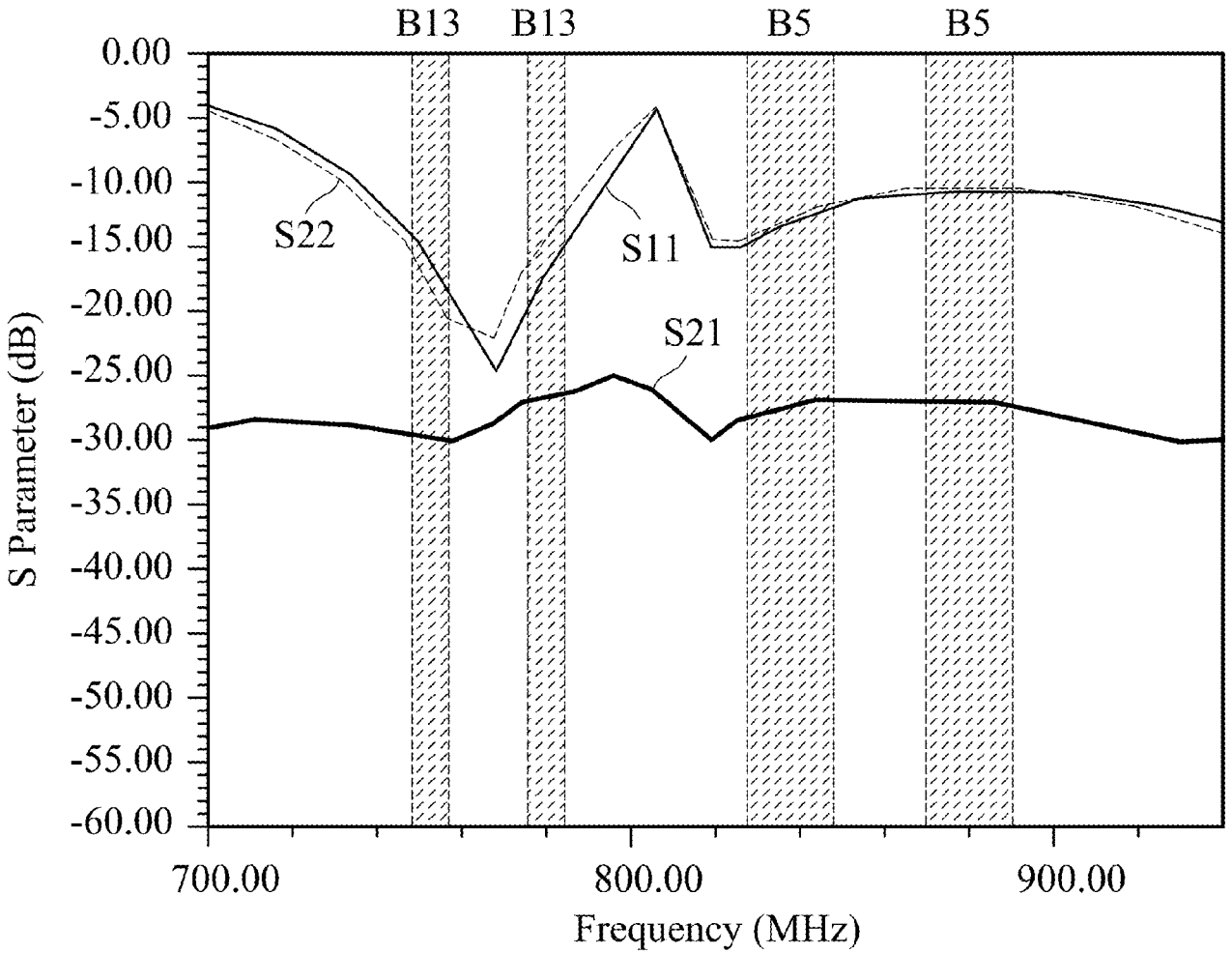
FIG. 4A is an S-parameter diagram of an antenna system operating in a low-frequency band, according to an embodiment of the invention.

FIG. 4A is an S-parameter diagram of the antenna system 100 operating in the low-frequency band, according to an embodiment of the invention. The horizontal axis represents the operation frequency (MHz), and the vertical axis represents the S-parameters (dB). The first antenna element 120 of the dual-polarized antenna 110 is considered as a first port (Port 1), and the second antenna element 130 of the dual-polarized antenna 110 is considered as a second port (Port 2). The curve S11 represents the return loss of the first antenna element 120. The curve S22 represents the return loss of the second antenna element 130. The curve S21 represents the isolation between the first antenna element 120 and the second antenna element 130. According to the result of the electromagnetic simulation software shown in FIG. 4A, both the first antenna element 120 and the second antenna element 130 can cover the low-frequency band of LTE Band 5/13, and the S21 parameter between the first antenna element 120 and the second antenna element 130 is below −25 dB over the low-frequency band.

Figure 4B:
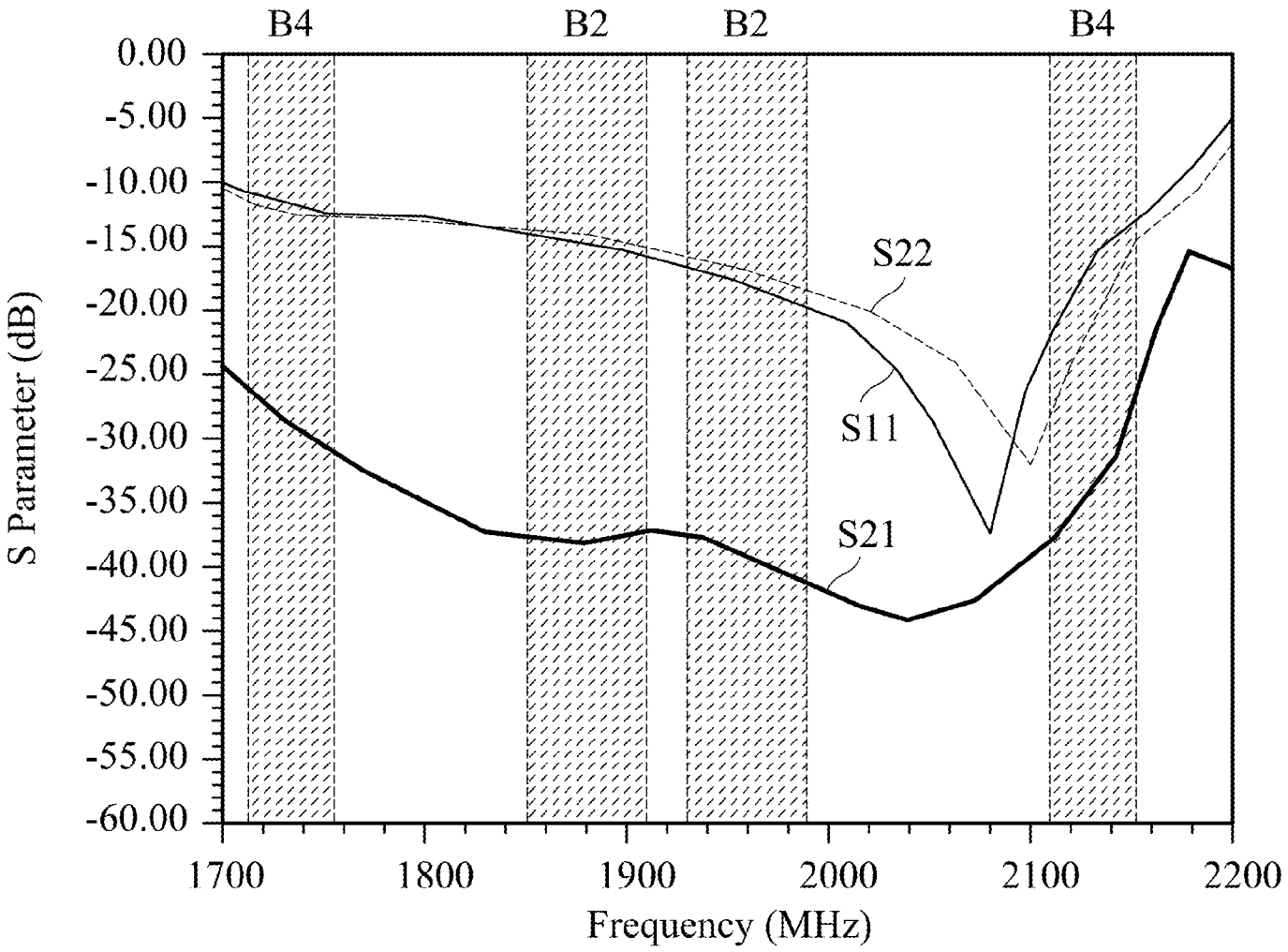
FIG. 4B is an S-parameter diagram of an antenna system operating in a high-frequency band, according to an embodiment of the invention.

FIG. 4B is an S-parameter diagram of the antenna system 100 operating in the high-frequency band, according to an embodiment of the invention. According to the result of the electromagnetic simulation software shown in FIG. 4B, both the first antenna element 120 and the second antenna element 130 can cover the high-frequency band of LTE Band 2/4, and the S21 parameter between the first antenna element 120 and the second antenna element 130 is below −25 dB over the high-frequency band.

In addition, according to the simulation results of the electromagnetic simulation software, each of the first antenna element 120 and the second antenna element 130 has cross-polarization isolation which is equal to or higher than 17.3 dB. The incorporation of the choke element 170 can increase the cross-polarization isolation to at least 25.4 dB in the frequency interval from 1710 MHz to 1755 MHz. The above electromagnetic simulation data show that the antenna system 100 can meet the requirement of application in mobile communication devices.

Figure 5:
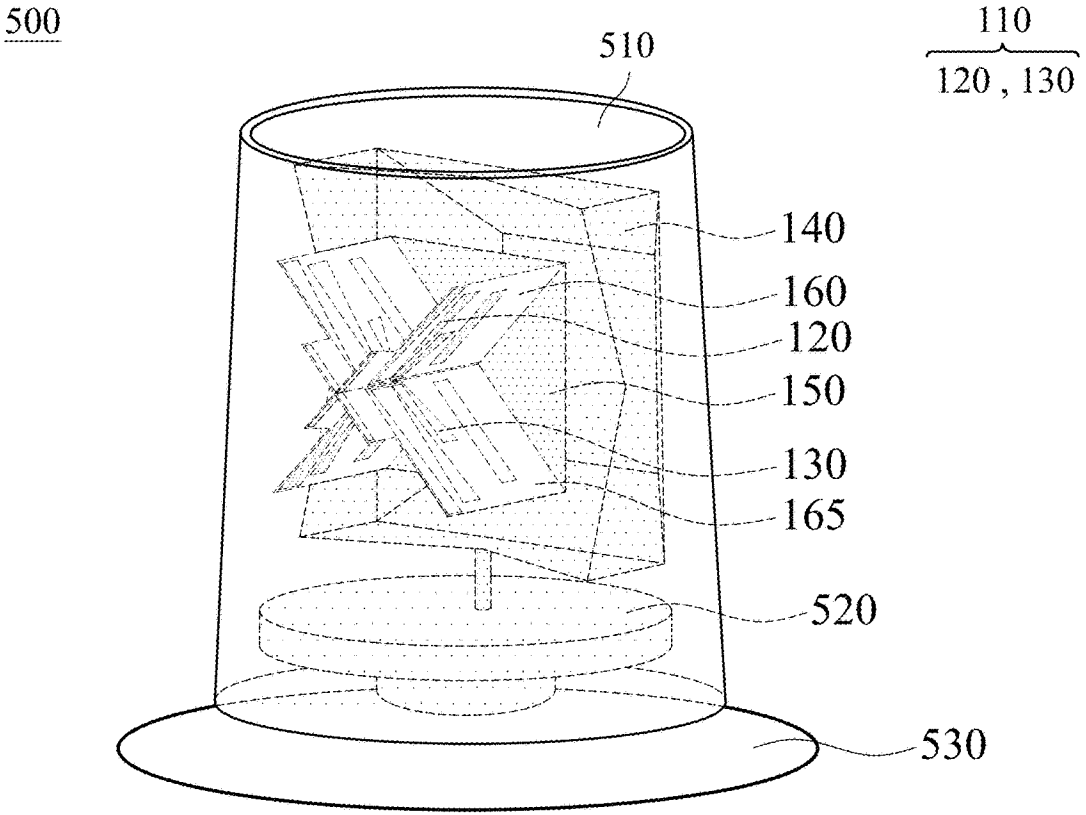
FIG. 5 is a perspective view of an antenna system according to another embodiment of the invention.

FIG. 5 is a perspective view of an antenna system 500 according to another embodiment of the invention. FIG. 5 is similar to FIG. 1A. In the embodiment of FIG. 5, the antenna system 500 further includes an antenna cover 510, a rotary motor 520, and a metal bottom plate 530. The antenna cover 510 is made of a nonconductive material, such as a plastic material. The antenna cover 510 may have a pyramid structure and a hollow cylindrical shape. The aforementioned dual-polarized antenna 110, main reflector 140, and auxiliary reflector 150 are all disposed inside the antenna cover 510. The rotary motor 520 is connected to the dual-polarized antenna 110, the main reflector 140, and the auxiliary reflector 150. In some embodiments, a processor generates a control signal, and the rotary motor 520 rotates the dual-polarized antenna 110, the main reflector 140, and the auxiliary reflector 150 according to the control signal, so as to fine-tune the maximum gain direction of the antenna system 500. The metal bottom plate 530 may have a circular shape, a rectangular shape, or a square shape, and it can support the antenna cover 510 and the rotary motor 520. The antenna cover 510 and the rotary motor 520 have vertical projections which are completely inside the metal bottom plate 530. With such a design, the main beam of the antenna system 500 is adjustable in response to a variety of requirements, and it can be set toward different desired directions. Therefore, the antenna system 500 is considered as a product of smart antenna.

The invention proposes a dual-polarized antenna system which includes a main reflector and an auxiliary reflector. The main reflector and the auxiliary reflector correspond to a low-frequency band and a high-frequency band, respectively, such that the antenna gain over the wide operation frequency band is uniformly improved. In addition, a choke element is arranged for a solution of high-frequency suppression. If a rotary motor is added, the proposed antenna system can have a tunable main beam direction, and it can be used as a high-gain smart antenna. The invention is suitable for application in a variety of indoor environments, so as to solve the problem of poor communication quality due to signal reflection and multipath fading in conventional designs.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-5. The invention may merely include any one or more features of any one or more embodiments of FIGS. 1-5. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a dual-polarized antenna, comprising a first antenna element and a second antenna element, wherein both the first antenna element and the second antenna element operate in a low-frequency band and a high-frequency band, and wherein the first antenna element and the second antenna element have different polarization directions;

a main reflector, reflecting electromagnetic waves in the low-frequency band; and an auxiliary reflector, disposed between the dual-polarized antenna and the main reflector, and reflecting electromagnetic waves in the high-frequency band, wherein the first antenna element is disposed on a first dielectric substrate, the second antenna element is disposed on a second dielectric substrate, and the second dielectric substrate is perpendicular to the first dielectric substrate.

2. The antenna system as claimed in claim 1, wherein the first antenna element has a first polarization direction, the second antenna element has a second polarization direction, and the second polarization direction is perpendicular to the first polarization direction.

3. The antenna system as claimed in claim 1, wherein the main reflector is a box without a lid, and a top opening of the box faces the dual-polarized antenna.

4. The antenna system as claimed in claim 1, wherein the auxiliary reflector is a plane.

5. The antenna system as claimed in claim 1, wherein the first antenna element and the second antenna element are dipole antenna elements or bowtie antenna elements.

6. The antenna system as claimed in claim 1, wherein each of the first antenna element and the second antenna element comprises a pair of first radiation elements, a pair of second radiation elements, and a pair of third radiation elements, and wherein the second radiation elements are disposed between the first radiation elements and the third radiation elements.

7. The antenna system as claimed in claim 6, wherein the first radiation elements and the second radiation elements are excited to generate electromagnetic wave in the low-frequency band, and wherein the third radiation elements are excited to generate electromagnetic wave in the high-frequency band.

8. The antenna system as claimed in claim 6, wherein each of the first antenna element and the second antenna element further comprises a pair of reflector elements for reflecting the electromagnetic waves in the high-frequency band, and wherein the reflector elements are disposed between the third radiation elements and the auxiliary reflector.

9. The antenna system as claimed in claim 6, wherein each of the first antenna element and the second antenna element further comprises a pair of director elements for directing the electromagnetic waves in the high-frequency band to transmit outwardly, and wherein the first radiation elements are disposed between the director elements and the second radiation elements.

10. The antenna system as claimed in claim 1, wherein each of the first antenna element and the second antenna element further comprises a signal source and a coaxial cable.

11. The antenna system as claimed in claim 10, wherein the coaxial cable comprises a conductive housing, and the conductive housing is soldered to the main reflector.

12. The antenna system as claimed in claim 11, wherein the auxiliary reflector has an opening, and the coaxial cable extends through the opening and does not directly touch the auxiliary reflector.

13. The antenna system as claimed in claim 12, wherein each of the first antenna element and the second antenna element further comprises a choke element.

14. The antenna system as claimed in claim 13, wherein the choke element is a low-pass filter.

15. The antenna system as claimed in claim 13, wherein the choke element is a hollow cylindrical tube which surrounds the coaxial cable.

16. The antenna system as claimed in claim 15, wherein the hollow cylindrical tube has an open end and a closed end, wherein the open end of the hollow cylindrical tube does not directly touch the coaxial cable, and wherein the closed end of the hollow cylindrical tube is soldered to the conductive housing of the coaxial cable.

17. The antenna system as claimed in claim 15, wherein a length of the hollow cylindrical tube is shorter than 0.25 wavelength of the high-frequency band.

18. The antenna system as claimed in claim 13, wherein the choke element is an L-shaped element, wherein the L-shaped element has a connection end and an open end, wherein the connection end of the L-shaped element is soldered to the conductive housing of the coaxial cable, and the open end of the L-shaped element does not directly touch the coaxial cable.

* * * * *